United States Patent [19]

Clarno

[11] Patent Number: 5,010,792

[45] Date of Patent: Apr. 30, 1991

[54] SOCKET WRENCH DRILL ATTACHMENT

[76] Inventor: Mark L. Clarno, 2649 Garfield St., Longview, Wash. 98632

[21] Appl. No.: 379,069

[22] Filed: Jul. 13, 1989

[51] Int. Cl.[5] ..... B25B 13/00

[52] U.S. Cl. ..... 81/58.1; 81/60; 81/63; 81/63.1

[58] Field of Search ..... 81/58.1, 60, 62, 61, 81/63, 63.1

[56] References Cited

U.S. PATENT DOCUMENTS

| | | | |
|---|---|---|---|
| 455,484 | 7/1891 | Fosburgh et al. | 81/63 |
| 951,056 | 3/1910 | Clark | 81/63 |
| 1,209,320 | 12/1916 | Morneweck | 81/63 |
| 1,605,776 | 11/1926 | Richards | 81/63 |
| 1,816,968 | 8/1931 | Greutman et al. | 81/63 |
| 3,572,188 | 3/1971 | Christian | 81/61 |
| 4,781,083 | 11/1988 | Cummings | 81/63.1 |

*Primary Examiner*—Frederick R. Schmidt
*Assistant Examiner*—Lawrence Cruz

[57] ABSTRACT

A ratchet wrench having an auxiliary triangular cross-sectioned stub shaft projecting therefrom for engagement in the chuck of a power drill. With the ratchet held in one hand, the power drill can be operated with the person's other hand to rapidly spin a nut or bolt off of (or onto) a threaded work member. The ratchet wrench can be operated alone (with the drill removed), to achieve a manual torquing or unloosening of the nut or bolt. The invention reduces the time required to install or remove a nut or bolt.

1 Claim, 1 Drawing Sheet

SOCKET WRENCH DRILL ATTACHMENT

BACKGROUND AND SUMMARY OF THE INVENTION

This invention relates to a multi-direction ratchet wrench useable with a power drill and a set of drive sockets to tighten and/or loosen nuts and bolts.

Under conventional practice nuts and bolts are loosened or tightened with a hand-operated ratchet wrench and a series of drive sockets. The wrench commonly includes a housing having an internal gear engaged with a ratchet mechanism so that the gear is free to turn in one direction, but not in the other direction. A manual lever is associated with the ratchet mechanism to change the direction in which the gear can freely turn.

An elongated manual handle extends from the wrench housing for imparting a turning motion to the housing and associated gear. A square cross-sectioned stub shaft extends axially from the gear out of the wrench housing for insertion into an appropriate drive socket.

The bolt or nut can be manually loosened or tightened by a back-and-forth turning movement of the wrench handle. During forward motion of the handle the housing and gear are rigidly connected together to apply a turning force to the nut or bolt. During reverse motion of the handle the ratchet mechanism and housing turn freely on the gear to reset the handle for another forward motion.

When the bolt or nut has a relatively long threaded area it may be necessary to move the handle several times in order to fully tighten or loosen the bolt or nut. For example, if we assume a handle motion of forty five degrees and a thread length of sixteen threads, then we would need two hundred fifty six handle motions to fully tighten or loosen the bolt (one hundred twenty eight forward strokes and one hundred twenty eight reset strokes.)

The present invention relates to a modification of the conventional ratchet wrench so that it can be used with a conventional power drill, to lessen the time required to tighten or loosen a nut or bolt. The ratchet wrench will be operated manually to apply a final tightening torque or to apply an initial unloosening torque The power drill will be used to spin the nut or bolt onto or off the associated threaded member. The principal object of the invention is to provide a mechanism that can reduce the time required to fully install or remove a nut or bolt. The invention mechanism will find its principal use in situations where the thread system has a relatively long engaged thread length.

THE DRAWINGS

DESCRIPTION OF A PREFERRED EMBODIMENT OF THE INVENTION

Figure 1:
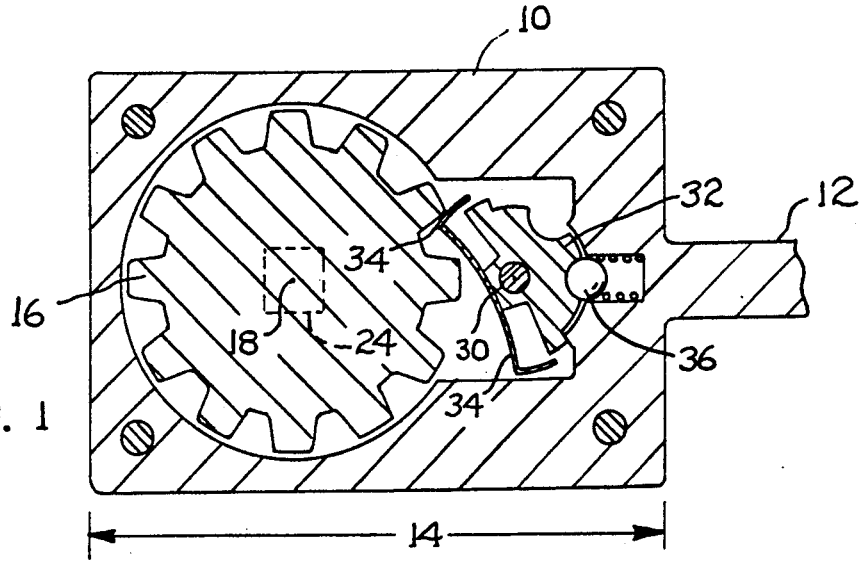
FIG. 1 is a sectional view taken through a mechanism embodying invention.
Figure 2:
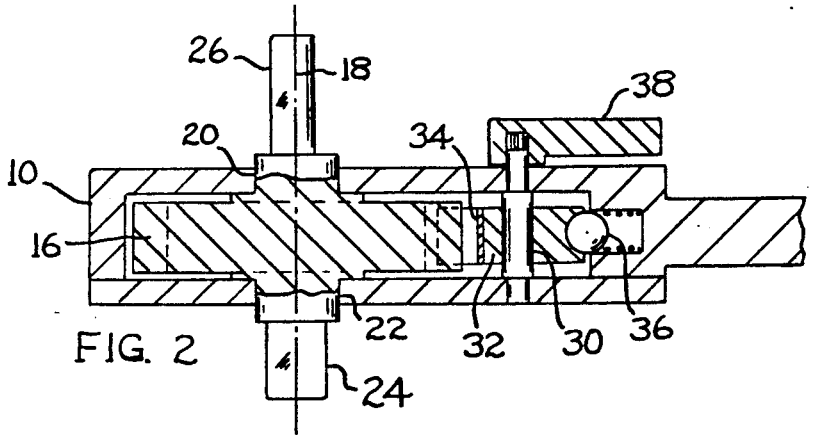
FIG. 2 is a sectional view on line 2—2 in FIG. 1.

The drawings show a ratchet wrench that includes a housing 10 attached to an elongated handle 12; the handle length will be greater than the housing dimension so that a satisfactory torque can be imparted to the nut or bolt (not shown). If housing dimension 14 is two inches the handle length may be on the order of eight inches.

A rotary gear 16 is mounted within the housing for rotation on an axis 18. Axially-extending circular portions 20 and 22 of the gear seat within circular openings in the housing walls to rotatably position the gear within the housing.

Projecting from the lower face of gear 16 is a square cross-sectioned stub shaft 24. A triangular cross-sectioned stub shaft 26 projects from the upper face of gear 16 on rotation axis 18.

Shaft 24 is adapted to mate with a conventional drive socket (not shown). Shaft 26 is adapted to mate with a chuck of a conventional electric power drill, not shown. When shaft 26 is gripped by the drill chuck the operator will hold the drill in his right hand; he will hold handle 12 in his left hand (assuming he is right handed). The trigger on the drill will be depressed to rotate the drill, thereby causing the drive socket to spin the bolt or nut onto or off of the associated threaded work member; the operation is relatively rapid, usually requiring only one or two seconds. Handle 12 will be turned manually to apply the final tightening torque (or to initially break the nut or bolt loose); during such time the power drill will be removed from shaft 26.

Figure 3:
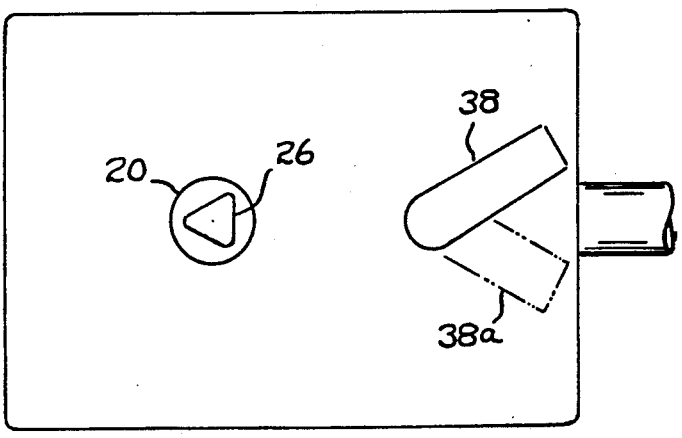
FIG. 3 is a top plan view of the FIG. 2 mechanism.

The ratchet wrench construction will be conventional, except for shaft 16. Shaft 16 represents the contribution of the present invention. Any conventional ratchet mechanism may be used within housing 10. As shown in the drawing, the ratchet mechanism comprises a rotary shaft 30 having a carrier disk 32 thereon for supporting a ratchet spring 34. A spring-urged ball detent 36 holds carrier disk 32 in either of two selected positions. A manual lever 38 is attached to the exposed end of shaft 30 to rotate the shaft so as to effectively adjust the ratchet direction of spring 34. In the position of FIG. 1, spring 34 enables handle 12 to turn freely in a clockwise direction (assuming gear 16 remains stationary); in the opposite direction handle 12 and gear 16 move together. By manually turning lever 38 to dashed line position **38*a* (FIG. 3) spring 34 will be repositioned to enable handle 12 to turn freely in a counterclockwise direction (relative to gear 16); in the clockwise direction handle 12 and gear 16** would move together. The illustrated ratchet mechanism is illustrative of various ratchet mechanisms that can be used in practice of the invention.

Handle 12 will be used to apply a manual torque to the nut or bolt, to initially break the nut or bolt loose, or to finally tighten the nut or bolt onto the work (depending on the adjusted position of lever 38). The power drill will be used in conjunction with the illustrated wrench to rapidly spin the nut or bolt onto or off of the threaded workpiece. Use of the drill reduces the number of back-and-forth manual movements of handle 12 required to fully install or remove the nut or bolt.

The triangular cross section of shaft 26 is beneficial in that it enables the shaft to be chucked into the drill chuck without necessarily clamping the chuck jaws tightly onto the shaft. The three corners of the triangular shaft will fit into the spaces between the three drill chuck jaws so that the jaw faces do not necessarily have to exert clamp forces on the shaft flat surfaces. The drill can be quickly connected to shaft 26 or removed from shaft 26 without spending time to fully tighten the drill chuck on the shaft.

Shaft 26 is preferably somewhat longer than stub shaft 24 in order to have sufficient shaft length to achieve full penetration of shaft 26 into the drill chuck. Also, the shaft 26 diameter (measured through the shaft axis) will be somewhat less than the shaft 24 diameter (measured diagonally across the shaft corners).

The drawings necessarily show a specific form of the invention. It will be understood that some structural variations can be used while still practicing the invention.

I claim:

1. A ratchet wrench, comprising a housing having a manually rotatable housing having a rotation axis; an elongated handle extending from said housing away from the rotation axis; a gear mounted within said housing for rotation on said axis; a manually-operated ratchet mechanism mounted within said housing in operative engagement with said gear for causing the gear to have one way rotary motion; a square cross-sectioned stub shaft extending from one face of said gear out of said housing on the rotation axis, said square cross-sectioned shaft having four straight flat sides thereon adapted to mate with a wrench socket; and a triangular cross-sectioned stub shaft extending from the other face of said gear out of said housing on the rotation axis, said triangular cross-sectioned shaft having three straight flat sides thereon adapted to fit into the chuck of a power drill whereby said gear can be power driven while the human operator grasps said handle to hold the housing motionless; said manually-operated ratchet mechanism including a carrier (32) rotatably mounted within the housing for rotation on a second axis parallel to the gear rotation axis, an external manual lever (38) connected to said carrier for rotating said carrier to two different positions, and a resilient means (34) mounted on said carrier, said resilient means having two oppositely-projecting ends adapted to selectively engage said gear, whereby one end of the resilient means has ratchet engagement with the gear in one position of the carrier, and the other end of the resilient means has ratchet engagement with the gear in a different position of the carrier; said lever being operable to adjust the position of the carrier to change the direction of rotation of said gear; said triangular cross-sectioned shaft having a greater axial length than the square cross-sectioned shaft; said triangular cross-sectioned shaft having a lesser diameter than the square cross-sectioned shaft.

* * * * *